US005541566A

United States Patent [19]

Deeney

[11] Patent Number: 5,541,566

[45] Date of Patent: Jul. 30, 1996

[54] DIAMOND-LIKE CARBON COATING FOR MAGNETIC CORES

[75] Inventor: Christopher Deeney, Hayward, Calif.

[73] Assignee: Olin Corporation, San Leandro, Calif.

[21] Appl. No.: 494,759

[22] Filed: Jun. 26, 1995

Related U.S. Application Data

[63] Continuation of Ser. No. 203,184, Feb. 28, 1994, abandoned.

[51] Int. Cl.[6] ..... H01F 17/06

[52] U.S. Cl. ..... 336/177; 428/216; 428/336; 428/408; 428/457

[58] Field of Search ..... 336/177; 428/408, 428/216, 336, 457, 694

[56] References Cited

U.S. PATENT DOCUMENTS

| | | | |
|---|---|---|---|
| 4,368,447 | 1/1983 | Inomata et al. | 336/20 |
| 4,447,795 | 5/1984 | Selko et al. | 336/178 |
| 4,482,879 | 11/1984 | Jackowicz | 336/55 |
| 4,603,314 | 7/1986 | Fukunaga et al. | 336/65 |
| 4,647,494 | 3/1987 | Meyerson | 428/216 |
| 4,735,840 | 4/1988 | Hedgcoth | 428/65 |
| 4,737,415 | 4/1988 | Ichijo et al. | 428/447 |
| 4,840,844 | 6/1989 | Futamoto et al. | 428/408 |
| 4,880,687 | 11/1989 | Yokoyama et al. | 428/408 |
| 4,902,998 | 2/1990 | Pollard | 336/60 |
| 4,983,859 | 1/1991 | Nakajima et al. | 307/419 |
| 5,097,241 | 3/1992 | Smith et al. | 336/60 |
| 5,124,179 | 6/1992 | Garg et al. | 427/249 |
| 5,126,206 | 6/1992 | Garg et al. | 428/408 |
| 5,135,808 | 8/1992 | Kimock et al. | 428/336 |
| 5,147,687 | 9/1992 | Garg et al. | 427/249 |
| 5,159,347 | 10/1992 | Osterwalder | 336/177 |
| 5,160,544 | 11/1992 | Garg et al. | 118/724 |
| 5,164,626 | 11/1992 | Oigawa | 310/208 |
| 5,186,973 | 2/1993 | Garg et al. | 427/590 |
| 5,190,807 | 3/1993 | Kimock et al. | 428/216 |
| 5,268,217 | 12/1993 | Kimock et al. | 428/216 |

OTHER PUBLICATIONS

Hitden et al "Sputtered Carbon on Particulate Mecka" IEE Transion Mag. vol. 26, No. 1 Jan. 1990.

ASM Handbook, vol. 2, Properties and Selection: Nonferrous Alloys and Special–Purpose Materials, (1990) "Metallic Glasses, Electronic and Magnetic Properties" at pp. 815–820.

*Primary Examiner*—Archene Turner

*Attorney, Agent, or Firm*—Gregory S. Rosenblatt

[57] ABSTRACT

There is provided a core for a magnetic switch. The core has a plurality of metallic strips, either as a coil or as stacked plates. Each strip is separated from adjacent strips by an electrically insulating polycrystalline carbon layer. The high thermal conductivity of the polycrystalline carbon layer facilitates cooling of the core during operation of the switch, greatly increasing the efficiency of the switch and its operational lifetime.

13 Claims, 3 Drawing Sheets

DIAMOND-LIKE CARBON COATING FOR MAGNETIC CORES

CROSS REFERENCE TO RELATED APPLICATION

This patent application is a continuation of U.S. patent application Ser. No. 08/203,184 by C. Deeney that was filed on Feb. 28, 1994 now abandoned.

BACKGROUND OF THE INVENTION

This invention relates to a core for a magnetic device such as an electromechanical switch. More particularly, a core is a plurality of strips of a magnetic material separated by a diamond-like, polycrystalline carbon coating.

High average power electronic devices requiring frequent pulsing such as linear induction accelerators for power station applications as well as high power microwave units utilize magnetic switches. The core of the magnetic switch is usually formed from a plurality of layers of a magnetic material separated by an electrically insulating inter-laminar material.

U.S. Pat. No. 4,368,447 to Inomata et al discloses forming a core by rolling a thin strip of an amorphous magnetic alloy into a coil. U.S. Pat. No. 4,447,795 to Sefko et al discloses a laminated magnetic core having a plurality of thin metallic strips bonded together and electrically insulated by a thin epoxy resin.

U.S. Pat. No. 4,983,859 to Nakajima et al, which is incorporated by reference in its entirety herein, discloses forming the core of a high power magnetic switch from a coil of an amorphous magnetic tape. A polyethylene terephthalate (MYLAR) film is disposed between the amorphous layers to provide electrical insulation. Rapid pulsing of the switch generates a substantial quantity of heat. To remove the heat, the core is divided into four separate spaced apart coils. A coolant flows around the outside of each coil and in the spaces separating the coils.

Even with cooling channels, the temperature at the center of the cores can reach 100° C. Elevated temperature operation reduces the operating efficiency and effective lifetime of the switch. Further, the size of the core must be increased to provide space for the cooling channels. The packing fraction, that volume percent of the core occupied by the magnetic material and contributing to the effectiveness of the switch, is only about 70% in this type of switch.

Two requirements of the interlaminar material are high electrical resistivity and a high breakdown voltage. One material meeting these requirements is polycrystalline carbon, also known as diamond-like carbon. As disclosed in U.S. Pat. No. 5,126,206 to Garg et al, which is incorporated by reference in its entirety herein, a polycrystalline diamond layer can be deposited on a substrate by streaming a gaseous mixture containing a hydrocarbon past a heated filament under a vacuum, typically less than 100 torr. The resultant hydrocarbon radicals are deposited as a carbon film on a cooled substrate. Under proper conditions, a polycrystalline carbon, diamond-like coating, is deposited on the substrate. The polycrystalline carbon has high electrical resistivity, typically greater than $10^6$ ohm-cm and a high breakdown voltage, typically greater than 100 volts.

Polycrystalline diamond layers have been used to provide electrical isolation between electronic devices and U.S. Pat. No. 5,135,808 to Kimock et al discloses the use of a polycrystalline diamond layer to provide abrasion resistance to an optically transparent substrate. To date, the unique properties of polycrystalline carbon have not been applied to magnetic cores.

SUMMARY OF THE INVENTION

Accordingly, it is an object of the invention to provide a core for a magnetic switch which provides improved operating efficiency and an enhanced lifespan. It is a feature of the invention that the core is formed from a plurality of magnetic material layers separated by a polycrystalline carbon coating. The magnetic material may be a continuous coil or a stack of plates. The magnetic material may be either an amorphous material or a magnetic metal or metal alloy.

Among the advantages of the invention is improved cooling of the core through the polycrystalline carbon eliminating the need for cooling channels within the core. Elimination of the need for cooling channels coupled with improved voltage hold-off increases the core packing fraction from 70% to 90%, by volume, increasing the switch efficiency by a factor of 30%. The core temperature during operation remains below 30° C. enhancing operating lifetime.

In accordance with the invention, there is provided a magnetic core. In one embodiment of the invention, the core is a thin strip of a magnetic material wound into a coil. Polycrystalline carbon is disposed between adjacent strips of the magnetic material. Alternatively, the magnetic core is a plurality of strips of a magnetic material stacked in a desired pattern. Polycrystalline carbon is disposed between adjacent strips of the magnetic material.

The above stated objects, features and advantages will become more apparent from the specification and drawings which follow.

DETAILED DESCRIPTION

Figure 1:
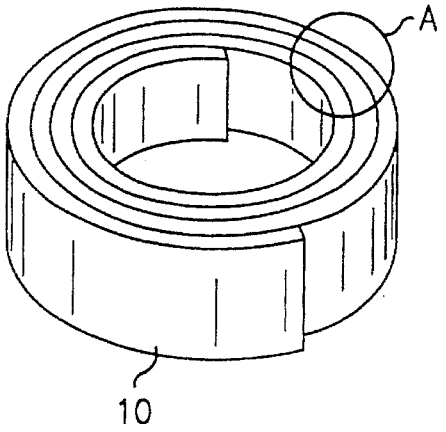
FIG. 1 (PRIOR ART)
FIG. 1 shows in isometric view a wound coil magnetic core as known from the prior art.

FIG. 1 shows in isometric view a core 10 for an electromagnetic device as known from the prior art. The core 10 is in the form of a coil formed by winding a strip of magnetic material in a helical configuration. The wound core 10 may be formed from any suitable magnetic material. Suitable magnetic materials include metals, metal alloys and amorphous materials. Suitable metal alloys include iron/silicon alloys and iron/cobalt alloys. Suitable amorphous materials include those of the formula:

$$(Fe_{1-x-y}Co_yNi_x)_{1-a}X_a$$

x is at least one element selected from the group P,B,C,Si,Ge and Al.

a=0.15–0.35.

x=0–0.7.

y=0–0.9.

Typical amorphous magnetic materials include:

$(Fe_{78}Si_8B_{14})$ $(Fe_{0.8}Ni_{0.2})_{78}Si_8B_{14}$ $(Fe_{0.5}Ni_{0.5})_{78}Si_8B_{14}$ $(Fe_{0.3}Ni_{0.5})_{78}Si_8B_{14}$ $(Fe_{0.3}Ni_{0.7})_{75}Si_8B_{14}$ $(Fe_{0.9}Co_{0.1})_{75}Si_{15}B_{10}$ $(Fe_{0.2}Co_{0.8})_{75}Si_{10}B_{15}$ $(Fe_{0.4}Ni_{0.5}Co_{0.1})_{80}Si_{10}B_{10}$ $Fe_{81}C_2Si_2B_{15}$ $Fe_{0.5}Ni_{0.5})_{78}Si_8C_2B_{12}$ $(Fe_{0.5}Ni_{0.5})_{78}Ge_2C_6B_{14}$ $Fe_{0.5}Ni_{0.5})_{78}P_{14}B_6Al_2$ $Fe_{80}B_{20}$

Figure 2:
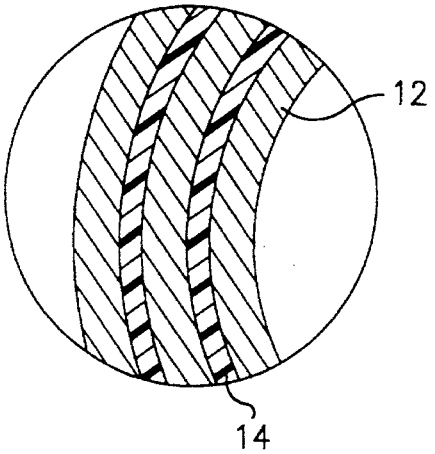
FIG. 2 (PRIOR ART)
FIG. 2 shows in top planar view the wound coil of FIG. 1 illustrating the interlaminar insulation as known from the prior art.

The magnetic material is wound into a coil. As shown in top planar view in FIG. 2, the coil includes a thin strip 12 of a magnetic material wound into a coil with a dielectric interlaminar material 14 disposed between adjacent strips 12 of the magnetic material. One dielectric material 14 is polyethylene terephthalate. Generally, the strips 12 are on the order of about 40 microns thick and have a height of about 1 centimeter. The dielectric material 14 has the thickness of about 8 microns and a height of about 1 centimeter.

Figure 3:
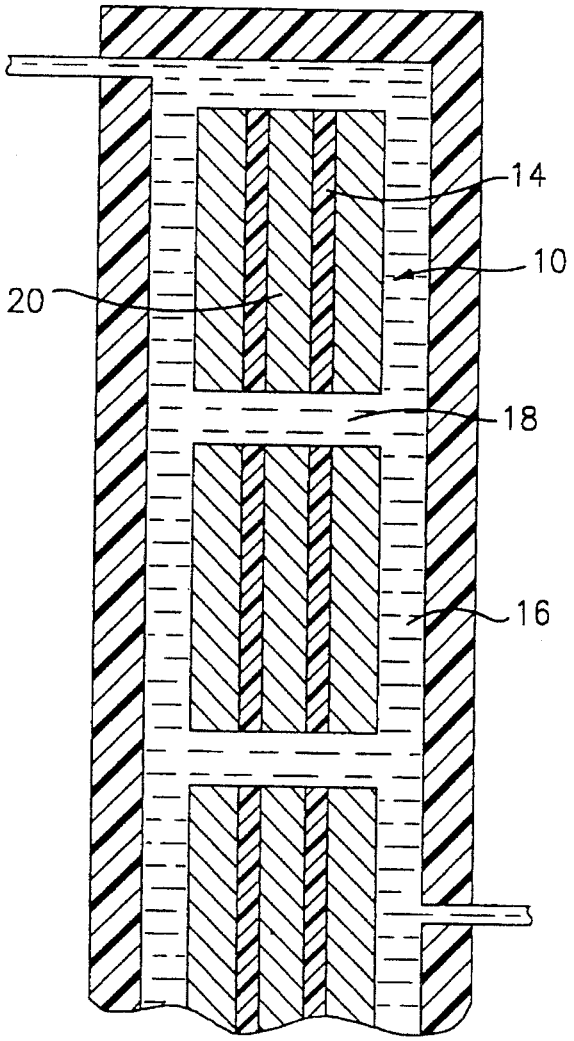
FIG. 3 (PRIOR ART)
FIG. 3 shows in cross-sectional representation a plurality of magnetic cores in a circulating coolant as known from the prior art.

The use of the core 10 in a magnetic switch is illustrated in FIG. 3. A plurality of wound cores 10 are immersed in a coolant 16 such as a silicone oil. To enhance cooling, the plurality of wound cores are separated by a channel 18 through which coolant 16 flows to enhance cooling. The channels 18 increase the size of the core and reduce the packing fraction, that is the volume fraction of the core occupied by the magnetic material, to about 70%.

The polymer based dielectric material 14 has poor thermal conductivity characteristics. Since heat is not rapidly withdrawn, the middle 20 of the coil becomes hot notwithstanding the cooling channels. It is not uncommon for the middle 20 of the coil 20 to exceed 100° C. Continued operation at elevated temperature causes a breakdown of the dielectric material 14 and a decrease in the efficiency of the magnetic switch.

Figure 4:
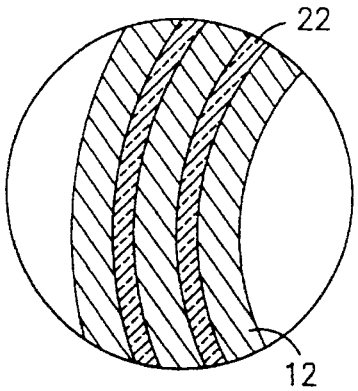
FIG. 4 shows in top planar view a wound coil in accordance with the invention.

The problems of the prior art switch are eliminated when the dielectric material disposed between adjacent portions of the magnetic material is polycrystalline carbon 22 as illustrated in FIG. 4. The thin strips of magnetic material 12 can be any suitable magnetic material, either a metal or amorphous material as discussed above. When amorphous, each strip has a thickness of from about 10 microns to about 100 microns, and preferably, from about 30 microns to about 50 microns. A most preferred amorphous material is a ferrite based metallic glass such as METGLAS 2605CO manufactured by Allied-Signal Inc., Morristown, N.J. The polycrystalline carbon has good electrical insulation along with good thermal conductivity, typically 10,000 times better than a polymer. For example, when the interlaminar layer is a polymer like polyethylene terephthalate, the coefficient of thermal conductivity is about 0.15 $Wm^{-1}$° C. When polycrystalline carbon, the coefficient of thermal conductivity is about 1,200 $Wm^{-1}$° C. As the result, a thinner layer of dielectric material 22 is required. When polycrystalline carbon, a thickness of from about 0.5 micron to about 10 microns is suitable. Preferably, the thickness is from about 2 to about 5 microns.

Figure 5:
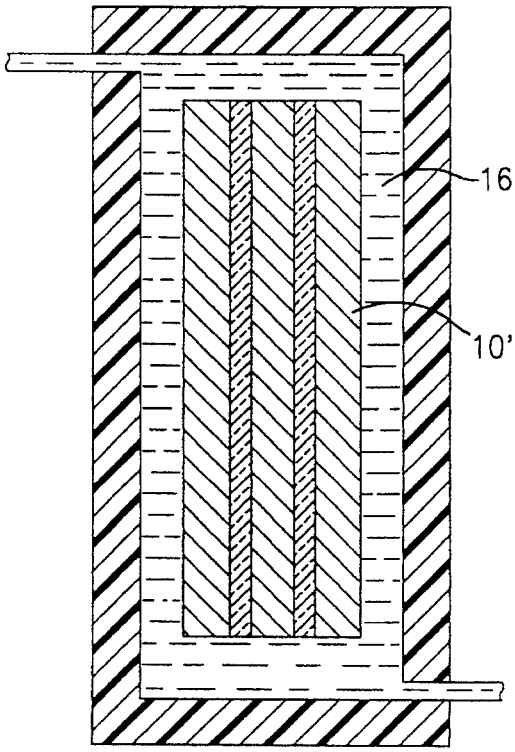
FIG. 5 shows in cross-sectional representation the magnetic core of the invention immersed in a coolant.

The improved radial and axial thermal conduction of the wound cores of the invention eliminates the need for cooling channels. FIG. 5 illustrates in cross-sectional representation a wound core 10' in accordance with the present invention. The wound core 10' is immersed in a coolant 16 such as silicone oil. Since cooling channels are not required, the packing density is on the order of 90% rather than the 70% of the prior art.

Table 1 summarizes the benefits achieved when the interlaminar layer is polycrystalline carbon rather than a polymer.

TABLE 1

| PROPERTY | POLYCRYSTALLINE CARBON | POLYMER |
|---|---|---|
| Voltage hold-off* (volts per micron) | 15–300 | 200 |
| Thermal conductivity $Wm^{-1}$ °C. | 1200 | 0.5 |
| Maximum operating temperature for switch °C. | ≧300 | 200–800 |
| Chemical & temperature resistance | High | Low |
| Deposition temperature (°C.) | 20–50 | not applicable |

Figure 6:
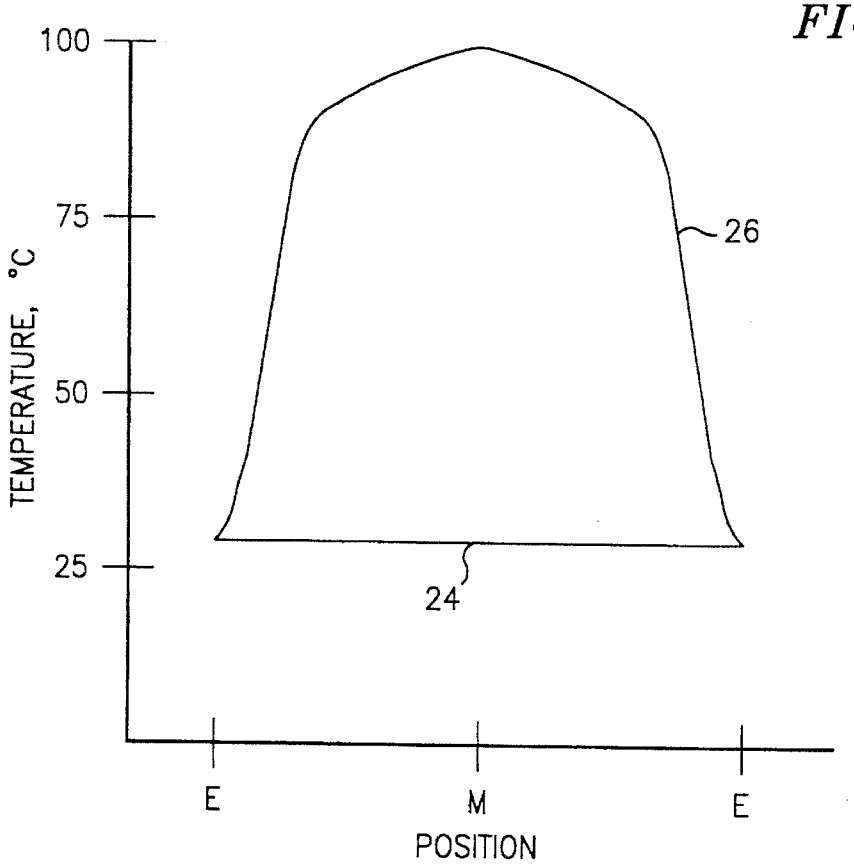
FIG. 6 graphically illustrates the temperature of a magnetic core pulsed switching.

FIG. 6 graphically illustrates the improved temperature distribution of the cores of the invention. The figure illustrates the steady state temperature of a core when operating at a voltage of 50 kV and subjected to a pulse frequency of 100 Hz. The data was calculated using thermal finite element analysis of a core utilizing the values of Table 1. Reference line 24 illustrates the core temperature is uniform from edge ("E") to middle ("M") when the interlaminar layer is polycrystalline carbon. Reference numeral 26 illustrates that the temperature rapidly increases away from the edges of a wound core when the interlaminar layer is a polymer and reaches a peak temperature at the middle of the core of approximately 100° C.

Figure 7:
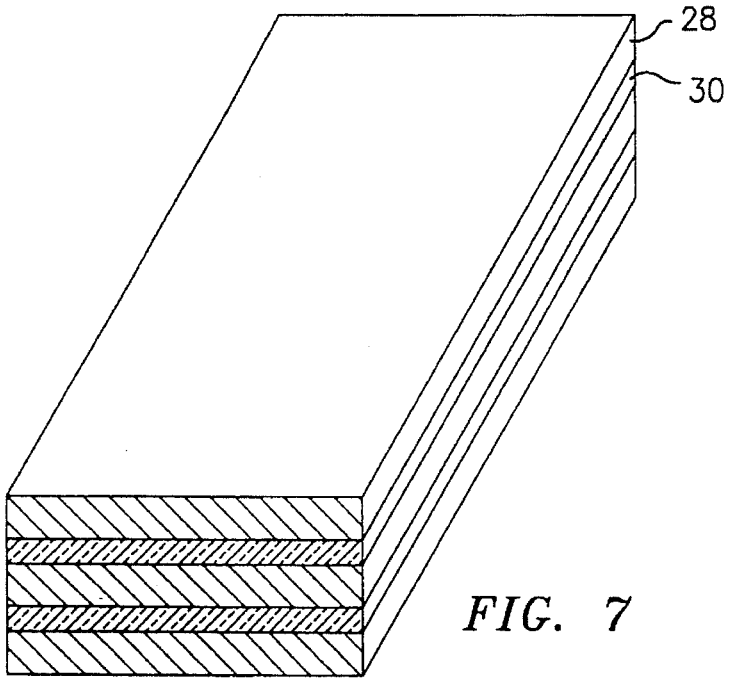
FIG. 7 shows in isometric view a magnetic core formed by stacking a plurality of magnetic plates in accordance with the invention.

As illustrated in FIG. 7, the advantages of the invention are not limited to a wound coil. Plates 28 of a magnetic material, either a metal or amorphous material as described above, may be stacked in any desired configuration, such as a rectangular block or a cylinder. Disposed between adjoining plates 28 is a layer 30 of polycrystalline carbon. As described above, the preferred thickness for the polycrystalline carbon is from about 0.5 micron to about 10 microns and preferably, from about 2 to about 5 microns.

Figure 8:
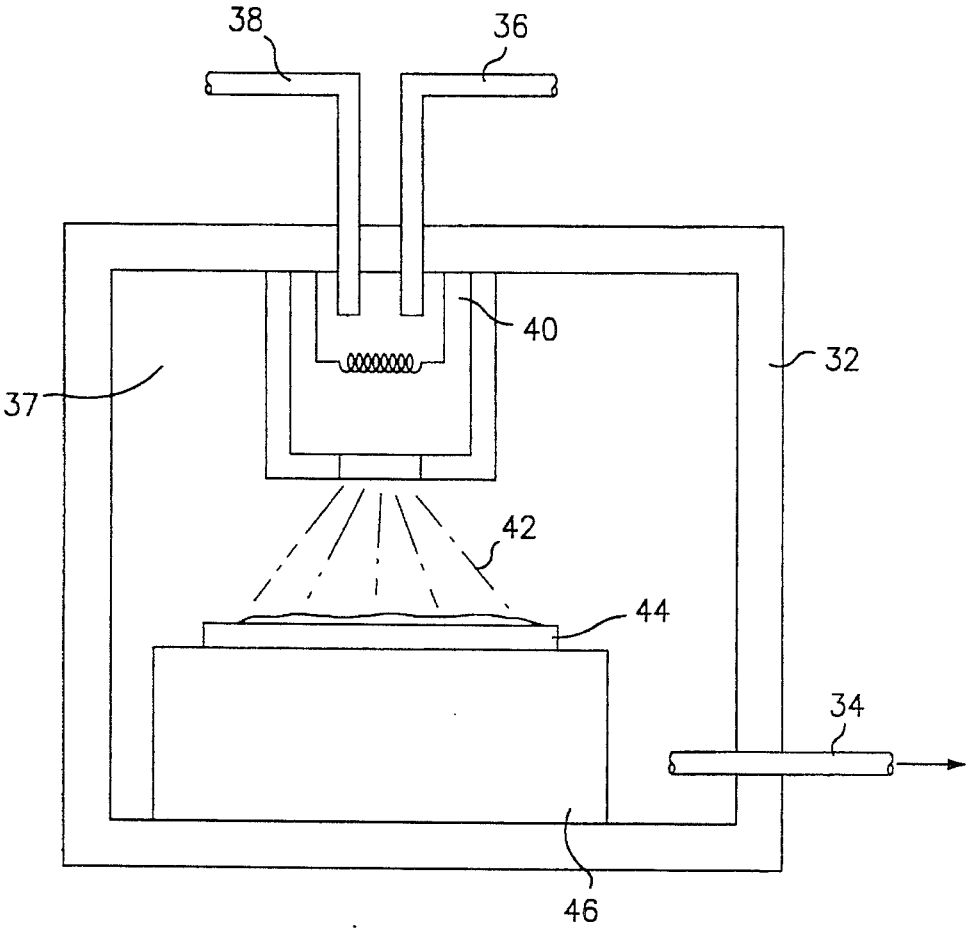
FIG. 8 schematically illustrates a method for depositing the polycrystalline carbon.

A method for the deposition of the diamond-like compound is schematically illustrated in FIG. 8. A housing 32 is under a vacuum 34 of less than 100 torr. A carbon containing feed gas 36 is delivered to the evacuated chamber 37. The feed gas is preferably methane, although any gas containing carbon, such as hydrocarbons, is suitable. An inert carrier gas 38, such as argon, is also delivered to the evacuated chamber 37 to dilute the feed gas 36 facilitating control of the coating thickness.

The feed gas 36 and carrier gas 38 stream past a hot filament 40 and are ionized according to conventional ion beam technology. The ionized feed gas forms a mixture 42 of hydrocarbon radicals and hydrogen radicals which are broadcast from the filament to a substrate 44. The substrate 44 is the strip of magnetic material described above.

When the strip of magnetic material 44 is an amorphous material, the strip 44 is maintained at a sufficiently low temperature to avoid recrystallization. The strip 44 is placed on a heat sink 46 such as a water cooled copper block. The polycrystalline diamond layer is then applied at a temperature of from about 10° C. to about 70° C. and preferably from about 20° C. to about 50° C. When the hydrocarbon radicals strike the strip 44, a polycrystalline carbon structure is deposited. By controlling the time of exposure, the thickness of the polycrystalline carbon layer can be accurately controlled.

Amorphous metals are usually formed by contacting a molten stream of metal with a chilled wheel to rapidly solidify the material. Only one side of the amorphous material contacts the chill wheel. As a result, the surface roughness of the two sides of the amorphous strip are different. It is known, as in U.S. Pat. No. 4,368,447, that the orientation of the sides of the strip following winding affects the magnetic properties of a switch. However, the present invention avoids the need to orient the switch. The polycrystalline carbon coating applied by the ion beam process is a conformational coating and smooths out the surface of the strip 44 such that when applied to the more coarse side, both sides of the strip are relatively smooth. The coils of the invention can be wound in either direction without detriment to the operation of the magnetic switch.

The patents described above are intended to be incorporated by reference in their entirety herein.

It is apparent that there has been provided in accordance with this invention a core for a magnetic switch which fully satisfies the objects, features and advantages described above. While the invention has been described in connection with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A magnetic switch, comprising a rolled magnetic core comprising:

a strip of a magnetic material wound into a coil conducting a pulsing electric current; and a polycrystalline carbon layer having a thickness of from about 0.5 microns to about 10 microns disposed between adjacent portions of said magnetic material, said core being free of channels to receive a liquid coolant.

2. The rolled magnetic core of claim 1 wherein said magnetic material is amorphous and has a thickness of from about 10 microns to about 100 microns.

3. The rolled magnetic core of claim 2 wherein the thickness of said amorphous magnetic material is from about 30 microns to about 50 microns.

4. The rolled magnetic core of claim 2 wherein the thickness of said polycrystalline carbon layer is from about 2 microns to about 5 microns.

5. The rolled magnetic core of claim 2 wherein said amorphous material is ferrite based.

6. A magnetic switch, comprising a magnetic core comprising:

a plurality of strips of a magnetic material stacked in a desired pattern conducting a pulsing electric current; and a polycrystalline carbon layer having a thickness of from about 0.5 micron to about 10 microns disposed between adjacent strips of said magnetic material, said core free of channels for receiving a liquid coolant.

7. The magnetic core of claim 6 wherein said magnetic material is amorphous and has a thickness of from about 10 microns to about 100 microns.

8. The magnetic core of claim 7 wherein the thickness of said polycrystalline carbon layer is from about 2 to about 5 microns.

9. The magnetic core of claim 7 wherein said desired pattern is a rectangular block.

10. A magnetic switch, comprising a core comprising:

a strip of magnetic material wound into a coil conducting a pulsing electric current; and a polycrystalline carbon layer having a thickness of from about 0.5 microns to about 10 microns disposed between adjacent portions of said magnetic material wherein the packing fraction of said core is about 70%–90% by volume.

11. The core of claim 10 wherein said packing fraction is about 90%.

12. A magnetic switch, comprising a core comprising a plurality of strips of a magnetic material stacked in a desired pattern conducting a pulsing electric current; and a polycrystalline carbon layer having a thickness of from about 0.5 micron to about 10 microns disposed between adjacent strips of said magnetic material wherein the packing fraction of said core is about 70%–90% by volume.

13. The core of claim 12 wherein said packing fraction is about 90%.

* * * * *